US008371770B1

(12) United States Patent
Rasmusson et al.

(10) Patent No.: US 8,371,770 B1
(45) Date of Patent: Feb. 12, 2013

(54) APPARATUS FOR TAMPING PAVING MATERIAL

(75) Inventors: Tobin D. Rasmusson, Bloomington, MN (US); Luke E. Graham, Maple Grove, MN (US); Jason W. Kopacz, St. Louis Park, MN (US); Anthony Steinhagen, Maple Grove, MN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/442,645

(22) Filed: Apr. 9, 2012

(51) Int. Cl.
*E01C 19/38* (2006.01)

(52) U.S. Cl. ..... 404/102; 404/114; 404/133.05

(58) Field of Classification Search ..... 404/102, 404/113, 114, 133.05, 133.1, 133.2; 405/271
See application file for complete search history.

(56) References Cited

U.S. PATENT DOCUMENTS

| | | | | |
|---|---|---|---|---|
| 3,614,916 | A | 10/1971 | Benson | |
| 4,127,351 | A | 11/1978 | Vural | |
| 4,493,585 | A | 1/1985 | Axer | |
| 4,502,813 | A * | 3/1985 | Hojberg | 404/102 |
| 4,507,014 | A | 3/1985 | Heims et al. | |
| 4,828,428 | A * | 5/1989 | Anderson | 404/102 |
| 5,165,820 | A | 11/1992 | Bunk et al. | |
| 5,947,638 | A | 9/1999 | Heims | |
| 6,019,544 | A * | 2/2000 | Emerson et al. | 404/104 |
| 6,124,580 | A * | 9/2000 | Nottmeier et al. | 219/635 |
| 6,238,135 | B1 | 5/2001 | Rower | |
| 6,551,018 | B2 | 4/2003 | Baker et al. | |
| 7,201,536 | B1 * | 4/2007 | Westbrook et al. | 404/108 |
| 2002/0168226 | A1 | 11/2002 | Feucht et al. | |
| 2011/0123267 | A1 | 5/2011 | Buschmann et al. | |
| 2011/0123270 | A1 | 5/2011 | Buschmann et al. | |
| 2011/0229263 | A1 * | 9/2011 | Buschmann et al. | 404/72 |
| 2011/0229266 | A1 * | 9/2011 | Buschmann et al. | 404/102 |

FOREIGN PATENT DOCUMENTS

| | | | |
|---|---|---|---|
| DE | 3127377 | A1 | 1/1983 |
| EP | 0374428 | B1 | 6/1990 |
| EP | 1179636 | B1 | 2/2002 |
| EP | 1905899 | A2 | 4/2008 |
| GB | 1132240 | A | 10/1968 |
| GB | 2091792 | A | 8/1982 |
| WO | 00/70150 | A1 | 11/2000 |

* cited by examiner

*Primary Examiner* — Gary S Hartmann
(74) *Attorney, Agent, or Firm* — Leydig, Voit & Mayer

(57) ABSTRACT

A tamper bar mechanism includes a drive shaft with an eccentric section on the shaft. A tamper drive member is driven by the eccentric section and drives a tamper bar between an upper position and a lower position to define a tamper stroke length. A stroke adjustment link is operatively connected to the tamper drive member and a stroke adjustment mechanism is operatively connected to the stroke adjustment link to adjust an angular orientation of the stroke adjustment link relative to the path of travel of the tamper bar and adjust a length of the tamper stroke length. A paving machine and a method of adjusting the tamper stroke length are also provided.

20 Claims, 4 Drawing Sheets

APPARATUS FOR TAMPING PAVING MATERIAL

TECHNICAL FIELD

This disclosure relates to paving machines and, more particularly, to an apparatus for controlling the stroke of a tamper mechanism during a paving process.

BACKGROUND

Paving machines are used to apply, spread and compact paving material relatively evenly over a desired surface. These machines are regularly used in the construction of roads, parking lots and other areas where a smooth durable surface is required for cars, trucks and other vehicles to travel. An asphalt paving machine generally includes a hopper for receiving asphalt material from a truck and a conveyor system for transferring the asphalt rearwardly from the hopper for discharge onto a roadbed. Screw augers may be used to spread the asphalt transversely across the roadbed in front of a screed plate. The screed plate smoothes and somewhat compacts the asphalt material and ideally leaves a roadbed of uniform depth and smoothness.

Although the screed plate compacts the asphalt material to some extent, it may be desirable to pre-compact the asphalt material prior to its engagement by the screed plate. A tamper mechanism may be positioned between the screw auger and the screed plate to perform such pre-compacting operation. Tamper mechanisms often includes a tamper bar, located in front of the screed plate relative to the direction of travel of the paving machine and extending transversely to the direction of travel. The tamper bar moves up and down, striking the asphalt material on each downward stroke to compact the asphalt material.

In some instances, it may be desirable to adjust the length of the stroke or amplitude of the movement of the tamper bar. For example, it may be desirable to adjust the length of the stroke depending on the desired thickness of the paved surface. The characteristics of the paving material as well as the speed of the paving machine may also contribute to a desired stroke length. However, existing tamper mechanisms generally require a time consuming process to adjust the tamper bar stroke. As a result, operators of paving machines often do not adjust the length of the stroke due to time constraints.

U.S. Patent Publication No. 2011/0123270 discloses a tamper mechanism that includes a tamper bar with an adjustable stroke length. An eccentric shaft is driven by a drive motor to move the tamper bar up and down. An eccentric bushing is provided that engages an eccentric section of the eccentric shaft. The length of the stroke of the tamper bar may be adjusted by loosening or removing hardware and then rotating the eccentric bushing relative to the eccentric section of the shaft. Once the eccentric bushing is positioned in the desired position relative to the eccentric section of the shaft, the bushing and shaft are fixed relative to each other by tightening or reapplying the mounting hardware.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a tamper bar mechanism includes a frame member with a drive shaft rotatably mounted on the frame member and an eccentric section on the drive shaft. A tamper drive member is operatively driven by the eccentric section and is configured to move about a path. A tamper bar is operatively connected to the tamper drive member and is configured for movement along a path of travel between an upper position and a lower position to define a tamper stroke length. A stroke adjustment link is operatively connected to the tamper drive member and a stroke adjustment mechanism is operatively connected to the stroke adjustment link to adjust an angular orientation of the stroke adjustment link relative to the path of travel of the tamper bar and adjust a length of the tamper stroke.

In another aspect, a paving machine for applying a paving material includes a machine frame, a prime mover mounted on the machine frame and a propulsion system for moving the paving machine. The paving machine also includes a screed assembly for smoothing the paving material, a feed system for moving the paving material towards the screed assembly, and a tamper bar mechanism between the feed system and the screed assembly for pre-compacting the paving material. The tamper bar mechanism includes a frame member with a drive shaft rotatably mounted on the frame member and an eccentric section on the drive shaft. A tamper drive member is operatively driven by the eccentric section and is configured to move about a path. A tamper bar is operatively connected to the tamper drive member and is configured for movement along a path of travel between an upper position and a lower position to define a tamper stroke length. A stroke adjustment link is operatively connected to the tamper drive member and a stroke adjustment mechanism is operatively connected to the stroke adjustment link to adjust an angular orientation of the stroke adjustment link relative to the path of travel of the tamper bar and adjust a length of the tamper stroke.

In another aspect, a method of adjusting a stroke length of a tamper bar on a paving machine is provided. The method includes providing a tamper bar configured for movement along a path of travel between an upper position and a lower position to define a tamper stroke length. A tamper bar link is provided that is operatively connected to the tamper bar. A tamper drive member is provided that is operatively connected to the tamper bar link. A rotatable drive shaft having an eccentric section is provided, the eccentric section being operatively connected to the tamper drive member. A stroke adjustment link is provided that is operatively connected to the tamper drive member. An angle between the tamper bar link and the stroke adjustment link is defined. The angle between the tamper bar link and the stroke adjustment link is adjusted to adjust the tamper stroke length.

DETAILED DESCRIPTION

Figure 1:
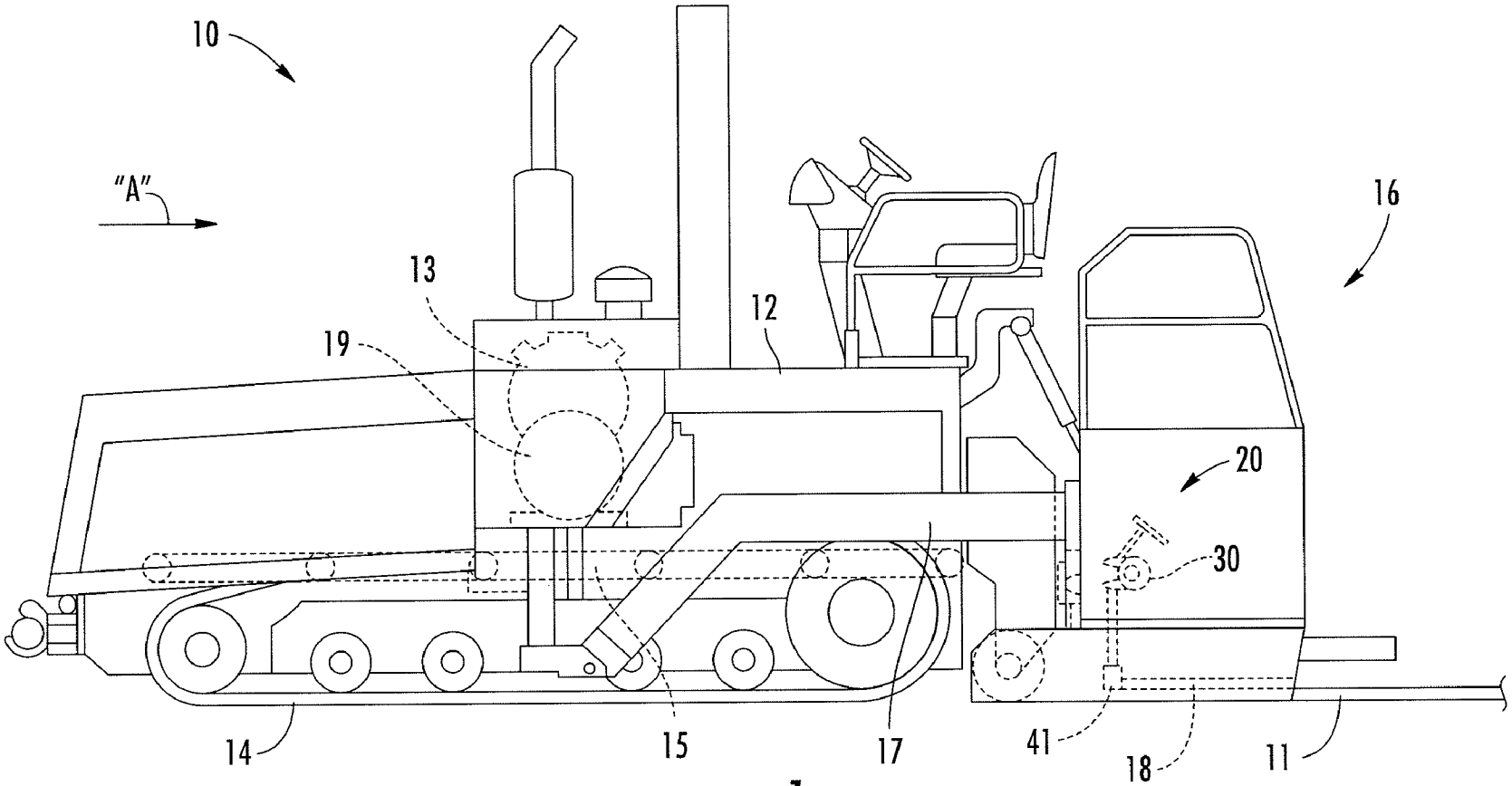
FIG. 1 is a diagrammatic side view of a paving machine including a tamper bar mechanism according to the present disclosure.

Referring to FIG. 1, a paving machine 10 for applying a layer of paving material 11, such as asphalt, is depicted. Paving machine 10 includes a machine frame 12, a prime mover 13, mounted on the machine frame and a propulsion system such as a driven track 14. Paving machine 10 further includes a feed system 15 for conveying paving material such as asphalt rearwardly relative to the paving machine and a screed assembly 16 that may be towed or otherwise connected to the paving machine 10 by a pair of tow arms 17 (only one being depicted in FIG. 1). The feed system 15 moves paving material rearwardly in the direction of arrow "A" and towards the screed assembly 16. An auger (not shown) may be used to laterally spread the paving material along the width of the screed assembly 16.

Screed assembly 16 may include a screed plate 18 and a tamper bar mechanism 20 positioned between the feed system 15 and the screed plate 18. The tamper bar mechanism 20 pre-compacts the paving material as the paving machine 10 moves forward (in a direction opposite arrow "A") and the screed assembly 16 smoothes the paving material to remove air pockets and other voids to create a flat, paved surface.

Figure 2:
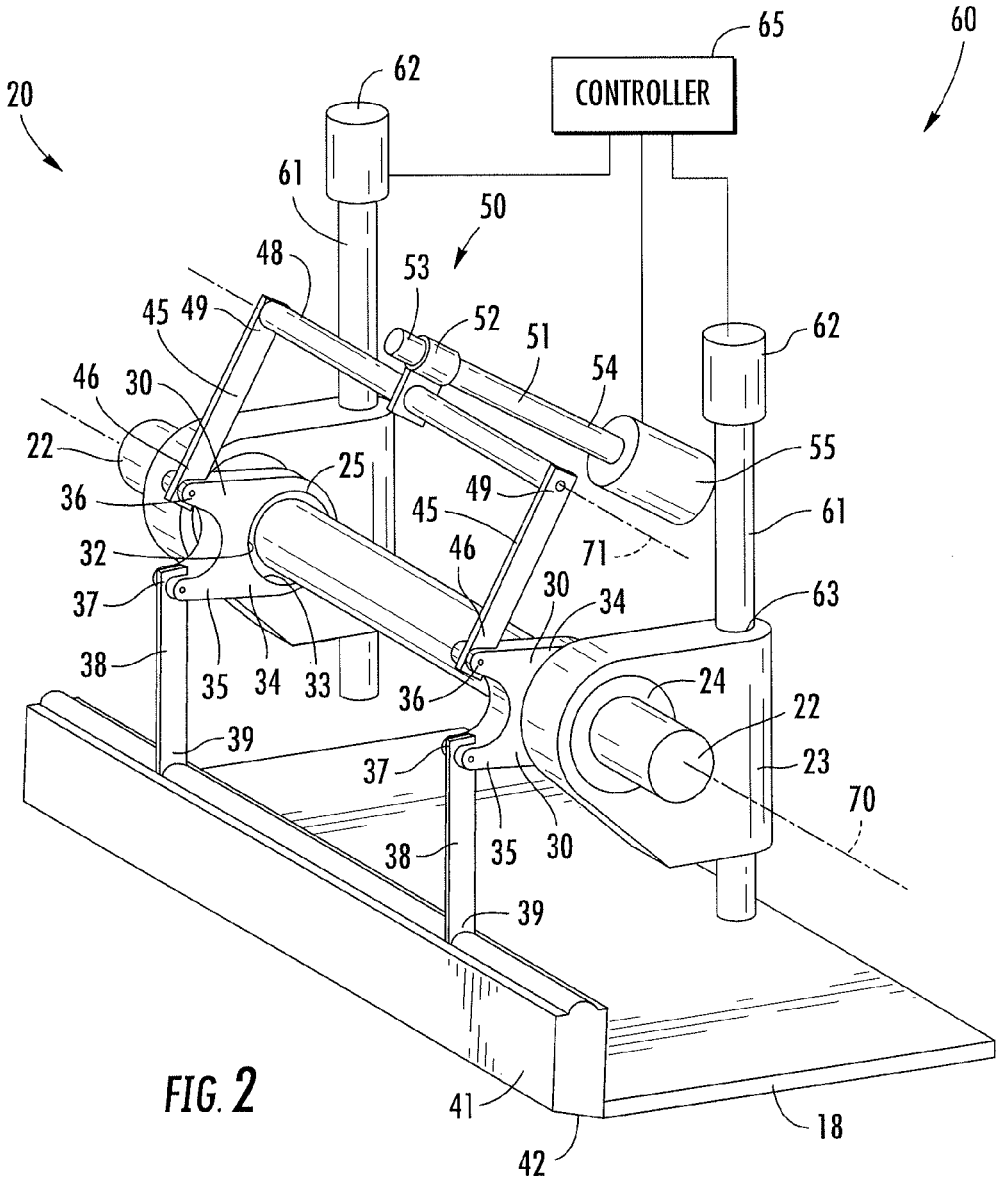
FIG. 2 is a diagrammatic perspective view of a tamper bar assembly and screed plate for use with the paving machine of FIG. 1.

Referring to FIG. 2, the tamper bar mechanism 20 includes an elongated, generally cylindrical main or drive shaft 22 that is rotatably mounted on a frame member 23 that may be positioned within or adjacent the screed assembly 16. Tamper bearings 24 may be mounted between the drive shaft 22 and the frame member 23 to support the drive shaft for rotation. The drive shaft 22 may further include one or more eccentric sections 25 operatively associated with the shaft. The eccentric sections 25 may be integrally formed as part of the drive shaft or may be formed separately such as eccentric bushings or bearings that are mounted on the drive shaft 22.

One or more tamper drive members 30 may be configured to be driven by the eccentric sections of drive shaft 22. More specifically, each tamper drive member 30 may include a generally cylindrical bore 32 within which an eccentric section 25 may rotate. A drive bearing 33 may be positioned between each eccentric section 25 of drive shaft 22 and the bore 32 of tamper drive member 30 to facilitate rotation of the eccentric section 25 within the bore 32.

Each tamper drive member 30 may include a generally U-shaped connecting section 34. The U-shaped connecting section 34 may include a lower or first leg 35 and an upper or second leg 36. A tamper bar link 38 may have a first end 37 pivotally connected to the first leg 35 of the tamper drive member 30. A second end 39 of each tamper bar link 38 may be pivotally connected to a tamper bar 41. The tamper bar 41 may be an elongated generally rectangular member with a generally flat paving material engagement surface 42 along a lower edge thereof. The paving material engaging surface 42 may be generally sloped downward along the direction of travel of the paving machine 10 (opposite arrow "A").

Drive shaft 22 may be driven by any of a plurality of power sources such as a mechanical drive (not shown) operatively connected to prime mover 13, an electric motor (not shown) driven by generator 19 or a hydraulic motor (not shown) driven by hydraulic fluid. Rotation of drive shaft 22 causes the eccentric section 25 on the drive shaft to rotate about the central axis 70 of the drive shaft. The rotation of the eccentric section 25 within the bore 32 of tamper drive member 30 causes the tamper drive member to move due to the rotation of the eccentric section. Movement of the tamper drive member 30 is restricted by the constraints on the U-shaped connecting section 34 as described in more detail below.

A stroke adjustment link 45 may operatively engage tamper drive member 30 to adjust the length of the stroke of tamper bar 41. A first end 46 of a stroke adjustment link 45 may be pivotally connected to the second leg 36 of each tamper drive member 30. A connecting bar 48 may extend between two or more stroke adjustment links 45 generally adjacent a second end 49 of the stroke adjustment links 45 to facilitate movement of the stroke adjustment links 45 together. Adjustment of the position of stroke adjustment links 45 changes the length of the stroke of tamper bar 41. By changing the position of stroke adjustment link 45, the angle between the tamper bar link 38 and the stroke adjustment link 45 may be adjusted. In addition, changing the position of the stroke adjustment link 45 also changes the angular position of the U-shaped connecting section 34 of tamper drive member 30.

Figure 6:
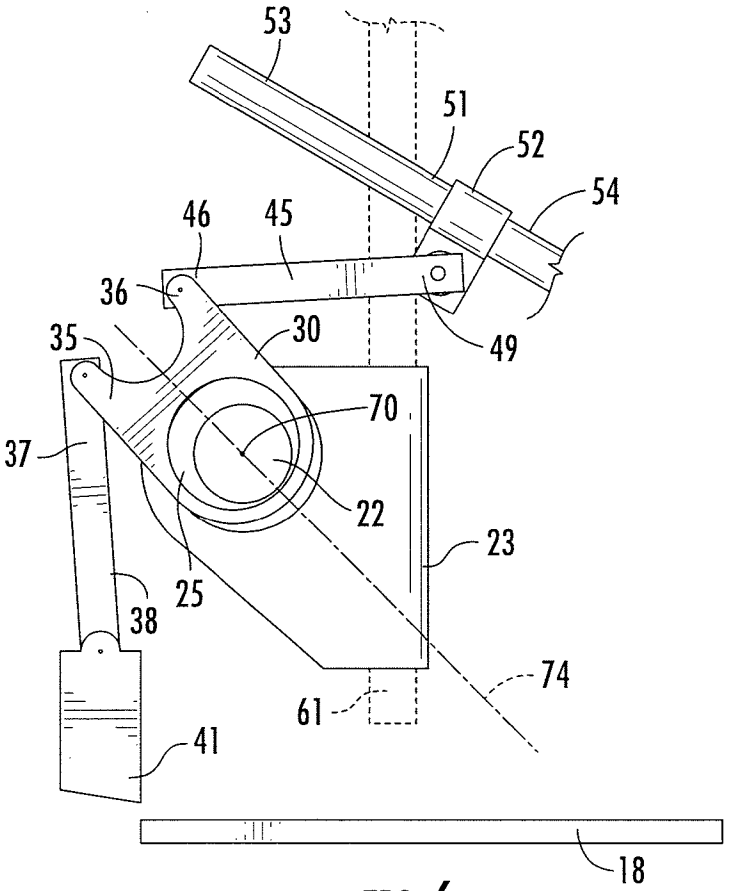
FIG. 6 is a diagrammatic view similar to FIG. 5 but with the tamper bar positioned at its upper position.

A stroke adjustment mechanism 50 may be provided to adjust the position of the second end 49 of each stroke adjustment link 45 and thus control the length of the stroke or amplitude of the movement of tamper bar 41. Stroke adjustment mechanism 50 may include a shaft 51 and a sleeve 52 or another member that is operatively connected to the shaft 51 to adjust the position of the second end 49 of the stroke adjustment link 45. In the embodiment depicted in FIGS. 2-6, the tamper bar 41 has a minimum stroke when the sleeve 52 is positioned adjacent the upper end 53 of shaft 51 (FIGS. 2-4) and has a maximum stroke when the sleeve is positioned adjacent the lower end 54 of the shaft (FIGS. 5-6).

Sleeve 52 is mounted on shaft 51 and controls the position of the connecting bar 48. The connecting bar 48 defines a moveable or adjustable axis of rotation 71 through the second end 49 of each stroke adjustment link 45. Although the adjustable axis of rotation 71 may be moved by adjusting the position of sleeve 52 relative to shaft 51, the adjustable axis of rotation 71 is fixed once the position of the sleeve 52 is established.

In one embodiment, shaft 51 may be threaded and sleeve 52 may include a complimentary threaded section so that rotation of shaft 51 causes movement of the sleeve 52 along the shaft and movement of the second end 49 of stroke adjustment link 45 along a generally linear path generally parallel to axis 75. A stroke adjustment motor 55 may be operatively connected to the shaft 51 to rotate the shaft as desired. Operation of the stroke adjustment motor 55 may be controlled by electronic controller 65.

Through the configuration described above, the first end 46 of each stroke adjustment link 45 is pivotally connected to the second leg 36 of the U-shaped connecting section 34 of tamper drive member 30. As a result, as the eccentric section 25 of the drive shaft 22 rotates within the bore 32 of each tamper drive member 30, the tamper drive member attempts to move with the eccentric section but is constrained by the fixed second end 49 of stroke adjustment link 45.

More specifically, the stroke adjustment link 45 pivots about the adjustable axis of rotation 71 with the first end 46 of the stroke adjustment link 45 together with the second leg 36 of the tamper drive member 30 moving in an arc about the adjustable axis of rotation 71. As a result, the tamper drive member 30 follows the path of movement of the eccentric section 25 but also pivots to some extent due to the constraint on the second leg 36. The movement of the eccentric section 25 within bore 32 of tamper drive member 30 together with the constraint on the second leg 36 causes movement of the first leg 35 of tamper drive member 30 in a somewhat elliptical path. In other words, the movement of the eccentric section 25 within the bore 32 of tamper drive member 30 combined with second leg 36 being constrained to move within an arc about adjustable axis of rotation 71 causes the first leg 35 to move in a somewhat elliptical path. Since the first leg 35 is pivotally connected to the tamper bar link 38, which is pivotally connected to the tamper bar 41, the tamper bar 41 is driven in a reciprocating linear path along double arrow "B" by the movement of the first leg 35.

Figure 4:
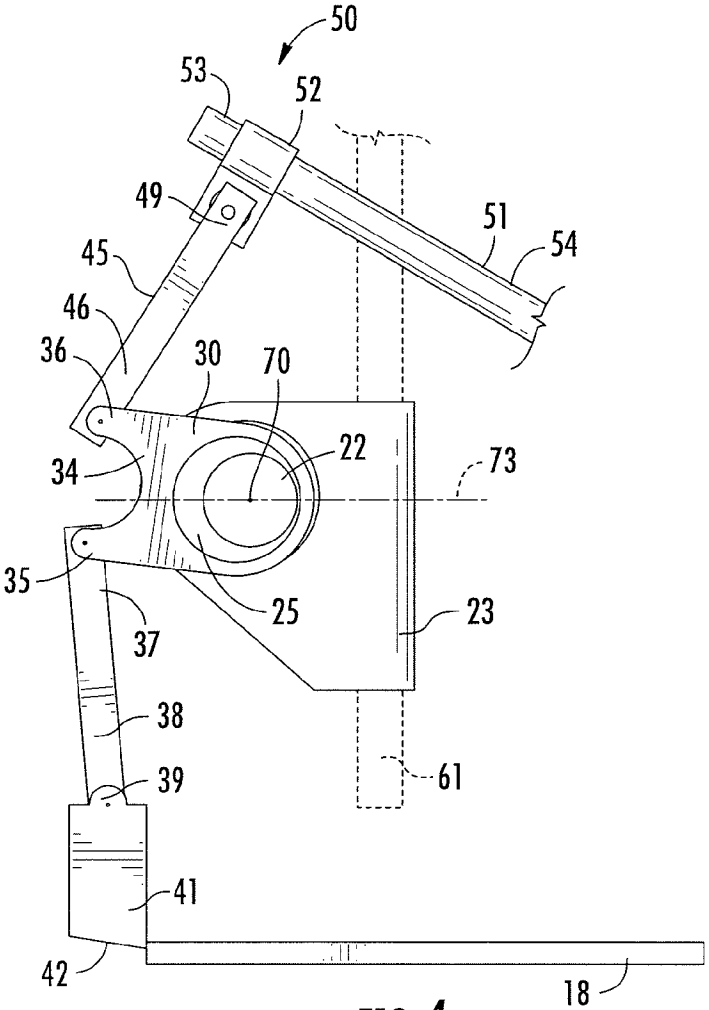
FIG. 4 is a diagrammatic view similar to FIG. 3 but with the tamper bar positioned at its upper position.
Figure 3:
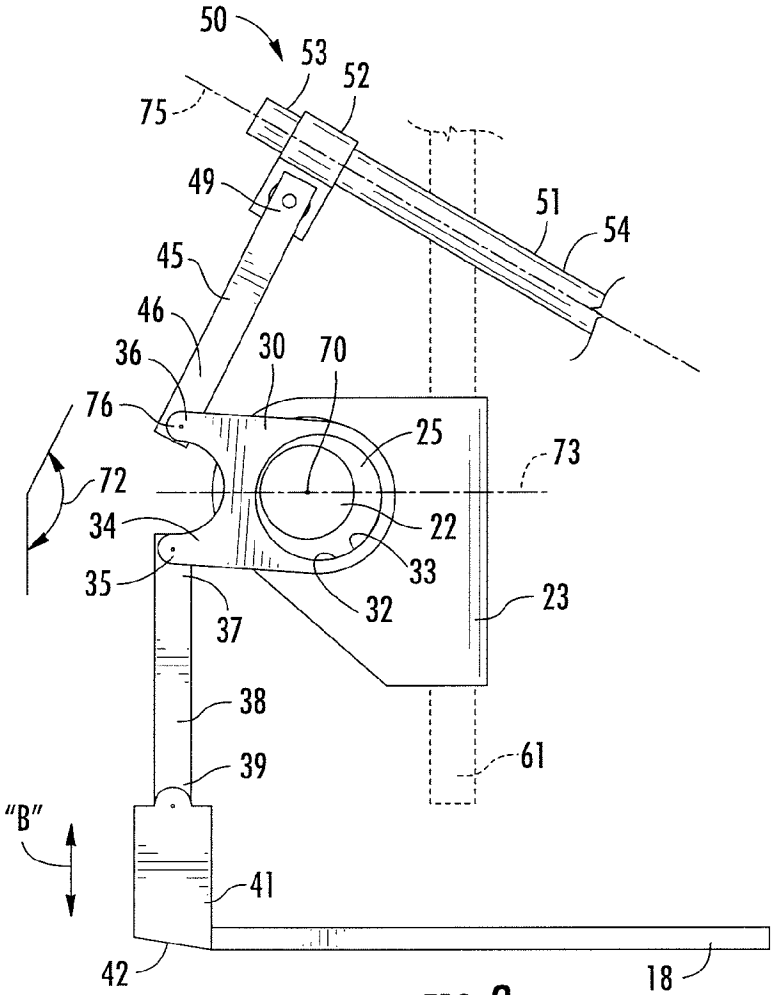
FIG. 3 is a diagrammatic side view of the tamper bar mechanism and screed plate of FIG. 2 with the tamper bar at its lower position and the tamper bar mechanism configured for a minimum tamper bar stroke.
Figure 5:
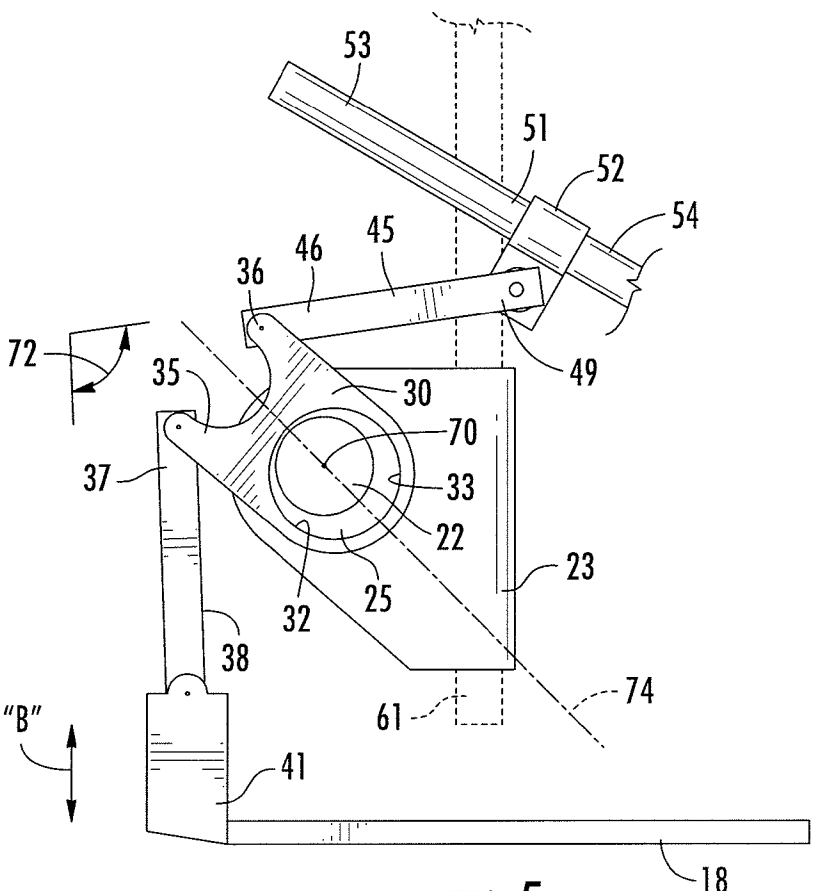
FIG. 5 is a diagrammatic view similar to that of FIG. 3 with the tamper bar in its lower position and with the tamper bar mechanism configured for a maximum tamper bar stroke.

As depicted in FIGS. 2-4, the tamper bar mechanism 20 is configured for a minimum stroke of the tamper bar 41. The sleeve 52 is positioned adjacent the upper end 53 of shaft 51 and the angle 72 between the tamper bar link 38 and the stroke adjustment link 45 is approximately 150°. During rotation of the drive shaft 22, the eccentric section 25 engages bore 32 which results in the first leg 35 of the tamper drive member 30 moving primarily laterally or horizontally. As a result, the first end 37 of tamper bar link 38 is primarily moving laterally relative to a ground reference so that the tamper bar 41 has its shortest stroke or minimum amplitude. As may be seen by comparing FIG. 3 to FIG. 4, the eccentric section 25 has moved primarily horizontally along horizontal line 73 and results primarily in horizontal movement of the tamper drive member 30 and its first leg 35. This horizontal movement results primarily in pivoting movement of the first end 37 of the tamper bar link 38 relative to the second end 39 which translates into minimal vertical movement of the tamper bar link 38 and the tamper bar 41.

The length of the stroke of tamper bar 41 may be adjusted by rotating shaft 51. By rotating shaft 51, sleeve 52 travels along the shaft 51 due to the interaction of the threads on/the shaft and the sleeve. With the sleeve 52 positioned generally adjacent the lower end 54 of shaft 51 as depicted in FIGS. 5-6, the stroke adjustment link 45 and thus tamper drive member 30 rotate clockwise (as depicted in the figures) relative to frame member 23. The rotation also moves the adjustable axis of rotation 71 downward so that the angle 72 between the tamper bar link 38 and the stroke adjustment link 45 is approximately 100°. As a result of this configuration, the first end 46 of stroke adjustment link 45 may move vertically more easily as compared to the configuration of FIGS. 2-4 (at which the stroke adjustment link 45 is positioned for the minimum tamper stroke length). During rotation of the drive shaft 22, the eccentric section 25 engages bore 32 which results in the first leg 35 of the tamper drive member 30 moving in both a vertical and horizontal manner. As a result, the first end 37 of tamper bar link 38 moves both horizontally and vertically relative to a ground reference so that the tamper bar 41 has its longest stroke or maximum amplitude as depicted in double arrow "B." As may be seen by comparing FIG. 5 to FIG. 6, the eccentric section 25 is at its lowest and highest positions along an angled line 74 at an angle of approximately 45° to a ground reference.

Rotation of the drive shaft 22 and the eccentric section 25 causes movement of the tamper drive member 30. The adjustable axis of rotation 71 that extends through the second end 49 of stroke adjustment link 45 is fixed so that the second leg 36 of tamper drive member 30 rotates about the adjustable axis of rotation 71. The constrained movement of the second leg 36 together with the movement of the bore 32 along eccentric section 25 causes the first leg 35 of U-shaped connecting section 34 to move in a somewhat elliptical path.

Referring to FIGS. 3-4 it may be seen that the movement of the tamper drive member 30 between the lower position depicted in FIG. 3 and the upper position depicted in FIG. 4 is primarily horizontal or generally parallel to the plane of screed plate 18. The path of movement of the first leg 35 is generally along a somewhat elliptical path with the major axis of the elliptical path being generally horizontal and the minor axis being generally vertical.

In FIGS. 5-6, the movement of the tamper drive member 30 between the lower position depicted in FIG. 5 and the upper position depicted in FIG. 6 is generally at an angle of approximately 45° to a ground reference. As such, the vertical component of movement of the first leg 35 is increased (as compared to FIGS. 3-4) which thus increases the length of the stroke of the tamper bar 41. The first leg 35 of the tamper drive member 30 moves in a generally elliptical path but the path is rotated with the major axis of the ellipse being generally along an angle of approximately 45° to the ground reference. By comparing FIGS. 3-4 to FIGS. 5-6, it may be seen that movement of sleeve 52 along shaft 51 from a position adjacent its upper end 53 to its lower end 54 results in a maximum change in the tamper stroke length. It may be understood that the tamper stroke length may be adjusted to any length between the minimum and maximum by positioning the sleeve 52 along shaft 51 intermediate the upper end 53 and the lower end 54 of the shaft.

Depending upon the dimensions of the various components of the tamper bar mechanism 20, it may be desirable or necessary to adjust the height of the drive shaft 22 relative to the ground reference to maintain the desired lower position (depicted in FIGS. 3 and 5) when adjusting the length of the tamper stroke. In order to adjust the height of the drive shaft 22 relative to the ground reference, it may desirable to allow the adjustment of the position of frame member 23 or distance from the ground reference. In one embodiment, the adjustment of the height of frame members 23 and thus drive shaft 22 may be carried out by a height adjustment mechanism 60 including a rotatable threaded shaft 61 (FIG. 2) that is driven by a height adjustment motor 62 and extends through a threaded bore 63 on a portion of the frame member 23. The engagement between the threaded shaft 61 and the threaded section 67 of the frame member 23 allows the vertical height of the frame member 23 to be modified by rotating the shaft. Controller 65 may be used to control the height adjustment motors 62 and rotate threaded shafts 61 to adjust the vertical height of the frame members 23 and thus the vertical height of drive shaft 22. If desired, the controller 65 may operate to drive height adjustment motors 62 and rotate shafts 61 and adjust the height of drive shaft 22 when the controller rotates shaft 51 to adjust the stroke of the tamper bar 41.

The controller 65 may be an electronic controller that operates in a logical fashion to perform operations, execute control algorithms, store and retrieve data and other desired operations. The controller 65 may include or access memory, secondary storage devices, processors, and any other components for running an application. The memory and secondary storage devices may be in the form of read-only memory (ROM) or random access memory (RAM) or integrated circuitry that is accessible by the controller. Various other circuits may be associated with the controller such as power supply circuitry, signal conditioning circuitry, driver circuitry, and other types of circuitry.

The controller 65 may be a single controller or may include more than one controller disposed to control various functions and/or features of the paving machine 10. The term "controller" is meant to be used in its broadest sense to include one or more controllers and/or microprocessors that may be associated with the paving machine 10 and that may cooperate in controlling various functions and operations of the machine. The functionality of the controller 65 may be implemented in hardware and/or software without regard to the functionality. The controller 65 may rely on one or more data maps stored in the memory of controller the equate the height of the frame member 23 relative to the length of the stroke of tamper bar 41 as well as the position of the screed plate 18. The optimal stroke and height relationship relative to screed plate 18 and frame member 23 may result from real-time or programmed machine performance parameters including, for example, paving speed, paving depth, and screed main frame angle of attack. Additional factors may include mat quality measurements such as, for example, temperature, density, texture, and smoothness. The stroke and height of the tamper bar 41 may be dictated by parameters loaded manually or otherwise to the controller 65 via an operator interface device or the like. Each of the data maps may include a collection of data in the form of tables, graphs, and/or equations.

It should be noted that stroke adjustment mechanism 50 may utilize other forms and structures to adjust the position of the adjustable axis of rotation 71 and thus the angle 72 of stroke adjustment link 45 relative to tamper bar link 38. For example, the threads on shaft 51 and sleeve 52 may be eliminated and the position of sleeve 52 along shaft 51 may be manually fixed by fasteners such as bolts (not shown). In another alternate embodiment, rather than using an electric motor 55 to rotate shaft 51 relative to sleeve 52, the second end 49 of stroke adjustment link 45 may be moved by a hydraulic cylinder (not shown) and generally along a path similar to an axis 75 (FIG. 3) through shaft 51. In still another alternate embodiment, a mechanism for adjusting the position of the adjustable axis of rotation 71 may rotate the stroke adjustment link 45 about an axis 76 through first end 42 of the stroke adjustment link and then secure the adjustable axis of rotation 71 in a desired position.

INDUSTRIAL APPLICABILITY

The industrial applicability of the system described herein will be readily appreciated from the foregoing discussion. The foregoing discussion is applicable to machines that utilize a tamper bar mechanism 20. In operation, paving material is loaded into the paving machine 10 and transported via the feed system 15 towards the screed assembly 16. The paving material may be spread laterally in front of the screed assembly 16 by an auger mechanism (not shown). Tamper bar mechanism 20 may be used to pre-compact the paving material prior to engagement of the paving material by the screed plate 18. The drive shaft 22 is driven so as to rotate about its central axis 70 on frame member 23. Rotation of the drive shaft 22 causes rotation of the eccentric section 25 on the drive shaft. Such movement of the eccentric section 25 causes the tamper drive member 30 to move or articulate about a path between a first drive position at which the tamper bar 41 connected to the tamper drive member 30 by the tamper bar link 38 is positioned at an upper position and a second drive position at which the tamper bar 41 is positioned at a lower position. The movement along the path of travel between the upper position and the lower position defines the tamper stroke and the tamper stroke length.

The length of the tamper stroke may be adjusted by changing the angular orientation of the stroke adjustment link 45 as well as the position of the second end 49 of the stroke adjustment link. More specifically, the stroke adjustment mechanism 50 is operatively connected to the stroke adjustment link 45 to adjust the angular orientation of the stroke adjustment link relative to the tamper bar link 38 and tamper bar 41. The angle of the stroke adjustment link 45 relative to the tamper bar link 38 may be used to control the length of the stroke of tamper bar 41. More specifically, general alignment between tamper bar link 38 and stroke adjustment link 45 restricts the ability of tamper bar link 38 to move vertically and thus limits the length of the vertical stroke of tamper bar 41 as depicted in FIGS. 3-4. Positioning the stroke adjustment link 45 generally at an angle closer to 90° permits greater vertical movement of the tamper bar link 38. This vertical movement translates into greater vertical movement of the tamper bar 41 and a greater stroke length as depicted in FIGS. 5-6.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A tamper bar mechanism comprising:

a frame member;

a drive shaft rotatably mounted on the frame member;

an eccentric section operatively associated with the drive shaft;

a tamper drive member operatively driven by the eccentric section and configured to move about a path;

a tamper bar operatively connected to the tamper drive member and configured for movement along a path of travel between an upper position and a lower position to define a tamper stroke length;

a stroke adjustment link operatively connected to the tamper drive member; and a stroke adjustment mechanism operatively connected to the stroke adjustment link to adjust an angular orientation of the stroke adjustment link relative to the path of travel of the tamper bar and adjust the tamper stroke length.

2. The tamper bar mechanism of claim 1, wherein the stroke adjustment mechanism includes a shaft along which an end of the stroke adjustment link may move.

3. The tamper bar mechanism of claim 2, wherein the shaft is threaded and further including a threaded section operatively associated with the end of the stroke adjustment link, the shaft and the threaded section being configured to cause movement of the end of the stroke adjustment link along the shaft upon rotation of the shaft.

4. The tamper bar mechanism of claim 1, further including a height adjustment mechanism to adjust the frame member relative to a ground reference.

5. The tamper bar mechanism of claim 4, wherein the height adjustment mechanism is configured to move the drive shaft relative to the ground reference upon changing the tamper stroke length.

6. The tamper bar mechanism of claim 1, wherein movement of the stroke adjustment mechanism further adjusts an angular orientation of the tamper drive member relative to the frame member.

7. The tamper bar mechanism of claim 1, further including a tamper bar link connecting the tamper bar to the tamper drive member.

8. The tamper bar mechanism of claim 1, wherein the eccentric section of the drive shaft includes a bushing mounted on the drive shaft.

9. The tamper bar mechanism of claim 1, wherein the eccentric section of the drive shaft is integrally formed as part of the drive shaft.

10. A paving machine for applying a paving material, comprising:

a machine frame;

a prime mover mounted on the machine frame;

a propulsion system for moving the paving machine;

a screed assembly for smoothing the paving material;

a feed system for moving the paving material towards the screed assembly; and a tamper bar mechanism between the feed system and the screed assembly for pre-compacting the paving material, the tamper bar mechanism including:

a frame member;

a drive shaft rotatably mounted on the frame member;

an eccentric section operatively associated with the drive shaft;

a tamper drive member operatively driven by the eccentric section and configured to move about a path;

a tamper bar operatively connected to the tamper drive member and configured for movement along a path of travel between an upper position and a lower position to define a tamper stroke length;

a stroke adjustment link operatively connected to the tamper drive member; and a stroke adjustment mechanism operatively connected to the stroke adjustment link to adjust an angular orientation of the stroke adjustment link relative to the path of travel of the tamper bar and adjust the tamper stroke length.

11. The paving machine of claim 10, wherein the stroke adjustment mechanism includes a shaft along which an end of the stroke adjustment link may move.

12. The paving machine of claim 11, wherein the shaft is threaded and further including a threaded section operatively associated with the end of the stroke adjustment link, the shaft and the threaded section being configured to cause movement of the end of the stroke adjustment link along the shaft upon rotation of the shaft.

13. The paving machine of claim 10, further including a height adjustment mechanism to adjust the frame member relative to a ground reference.

14. The paving machine of claim 13, wherein the height adjustment mechanism is configured to move the drive shaft relative to the ground reference upon changing the tamper stroke length.

15. The paving machine of claim 10, wherein movement of the stroke adjustment mechanism further adjusts an angular orientation of the tamper drive member relative to the frame member.

16. A method of adjusting a stroke length of a tamper bar on a paving machine, comprising:

providing the tamper bar configured for movement along a path of travel between an upper position and a lower position to define a tamper stroke length;

providing a tamper bar link operatively connected to the tamper bar;

providing a tamper drive member operatively connected to the tamper bar link;

providing a rotatable drive shaft operatively associated with an eccentric section, the eccentric section being operatively connected to the tamper drive member;

providing a stroke adjustment link operatively connected to the tamper drive member;

defining an angle between the tamper bar link and the stroke adjustment link; and adjusting the angle between the tamper bar link and the stroke adjustment link to adjust the tamper stroke length.

17. The method of claim 16, wherein the stroke adjustment link has a first end and a second end, the first end being operatively connected to the tamper drive member, and further including moving the second end to adjust the angle between the tamper bar link and the stroke adjustment link.

18. The method of claim 17, further including moving the second end along a generally linear path.

19. The method of claim 16, further including adjusting a distance of the rotatable drive shaft relative to a ground reference.

20. The method of claim 19, wherein the rotatable drive shaft is supported on a frame member and further including moving the frame member relative to the ground reference to adjust a distance of the rotatable drive shaft relative to the ground reference.

* * * * *

UNITED STATES PATENT AND TRADEMARK OFFICE

CERTIFICATE OF CORRECTION

PATENT NO. : 8,371,770 B1
APPLICATION NO. : 13/442645
DATED : February 12, 2013
INVENTOR(S) : Rasmusson et al.

It is certified that error appears in the above-identified patent and that said Letters Patent is hereby corrected as shown below:

In the Specification

Column 5, line 38, delete “on/the” and insert -- on the --.

Signed and Sealed this
Eleventh Day of August, 2015

Michelle K. Lee

Michelle K. Lee
*Director of the United States Patent and Trademark Office*